United States Patent [19]

Shah et al.

[11] 4,396,307

[45] Aug. 2, 1983

[54] METHOD AND APPARATUS FOR AUTOMATICALLY FEEDING CUT SHEETS TO A CHARACTER PRINTER

[75] Inventors: Franklin B. Shah, Fremont; John W. Jamieson, San Leandro, both of Calif.

[73] Assignee: Qume Corporation, San Jose, Calif.

[21] Appl. No.: 894,534

[22] Filed: Apr. 7, 1978

[51] Int. Cl.[3] ..... B41J 13/10

[52] U.S. Cl. ..... 400/625; 400/582; 400/629; 400/637.1; 400/639.1; 400/3

[58] Field of Search ..... 400/61, 62, 70, 76, 400/624, 625, 626, 627, 628, 629, 639.1, 639.2, 637.1, 582; 271/3, 3.1, 145

[56] References Cited

U.S. PATENT DOCUMENTS

| | | | |
|---|---|---|---|
| 2,142,245 | 1/1939 | Helmond | 400/637.1 |
| 2,288,797 | 7/1942 | Fettig | 400/625 X |
| 2,996,166 | 8/1961 | Bradshaw et al. | 400/582 X |
| 3,070,204 | 12/1962 | Bradshaw | 400/625 |
| 3,430,748 | 3/1969 | Parri | 400/625 |
| 3,960,258 | 6/1976 | Aebi | 400/582 X |
| 3,963,110 | 6/1976 | Hyland et al. | 400/629 X |
| 4,031,995 | 6/1977 | Blum et al. | 400/639.1 X |
| 4,078,485 | 3/1978 | Guthrie | 400/582 X |

*Primary Examiner*—Ernest T. Wright, Jr.

*Attorney, Agent, or Firm*—T. E. Kristofferson; J. M. May

[57] ABSTRACT

A sheet feeder for an impact daisywheel type printer is interconnected with an existing system by reconnecting the ASCII type data cable to the sheet feeder. The internal logic of the sheet feeder is cabled to the printer and provides for all necessary automatic control. The sheet feeder also includes a mechanical bail control which opens the bail to allow for automatic feeding of the paper around the platen.

4 Claims, 11 Drawing Figures

TIMING (NORMAL CYCLE)

METHOD AND APPARATUS FOR AUTOMATICALLY FEEDING CUT SHEETS TO A CHARACTER PRINTER

BACKGROUND OF THE INVENTION

The present invention is directed to a method and apparatus for automatically feeding a character printer and more specifically an impact printer of the daisywheel type.

Impact character printers of the daisywheel type readily lend themselves to repetitive typing tasks with separate or cut sheets of paper such as addressing, form letters, etc. Such printers, of course, can be a simple output device of a computer system or serve as a memory type office typewriter where in normal use single cut sheets of paper are used. Such a printer is also suited for automated operation—however, such dual use is thwarted since the printer must be suitable for manual operation and include such features as a typical typewriter bail which must be moved away from the platen as each cut sheet is inserted and then moved back again to provide for good registration. Moreover, printers even of the impact type such as Teletypewriters use continuous sheets of paper to avoid this problem.

Quasi automatic sheet feeders have been proposed in U.S. Pat. Nos. 3,430,748 and 3,963,110 but neither of these patents deal with the bail problem nor are they fully automated.

OBJECTS AND SUMMARY OF THE INVENTION

It is, therefore, a general object of the present invention to provide an improved automated impact printer.

It is another object of the invention to provide an automated impact printer which is easily convertible from manual operation to automatic operation with the addition of an automatic sheet feeder with the overall control of the system being transparent to the user.

It is another object of the invention to provide a system and method as above where the paper bail is easily controlled.

It is another object of the invention to provide a system and method as above where the sheet feeder easily interfaces with existing control and data lines of the impact printer.

In accordance with the above objects there is provided a method of storing, in a stack, cut sheets of material to be printed upon. Such sheets are automatically inserted one by one in a printer having a platen and bail. A sheet is moved from the stack into contact with the printer's platen. The bail is moved away from its platen and the printer is caused to move the sheet around to a first printing position where the sheet is between the bail and platen. The bail is then closed to allow it to hold down the sheet. Appropriate physical apparatus to carry out this method is also provided.

In addition another method concept is provided for automatically feeding the printer with cut sheets of material to be printed upon. Such printer has a platen rotatable by paper feed control signals and a port with ASCII type data and control lines. A sheet feeder is provided, holding cut sheets of material, on the printer. The port of the printer is connected to the feeder and the ASCII type data and control lines are connected to the sheet feeder. The paper feed of the printer is controlled by use of digital logic, within the feeder, to accept a sheet from the feeder.

And from a system standpoint there is provided a sheet feeder-printer combination where control logic means, which are in proximity to the system, provide for automatic operation in a manner which is transparent to the user.

DETAILED DESCRIPTION OF THE PREFERRED EMBODIMENT

Figure 1:
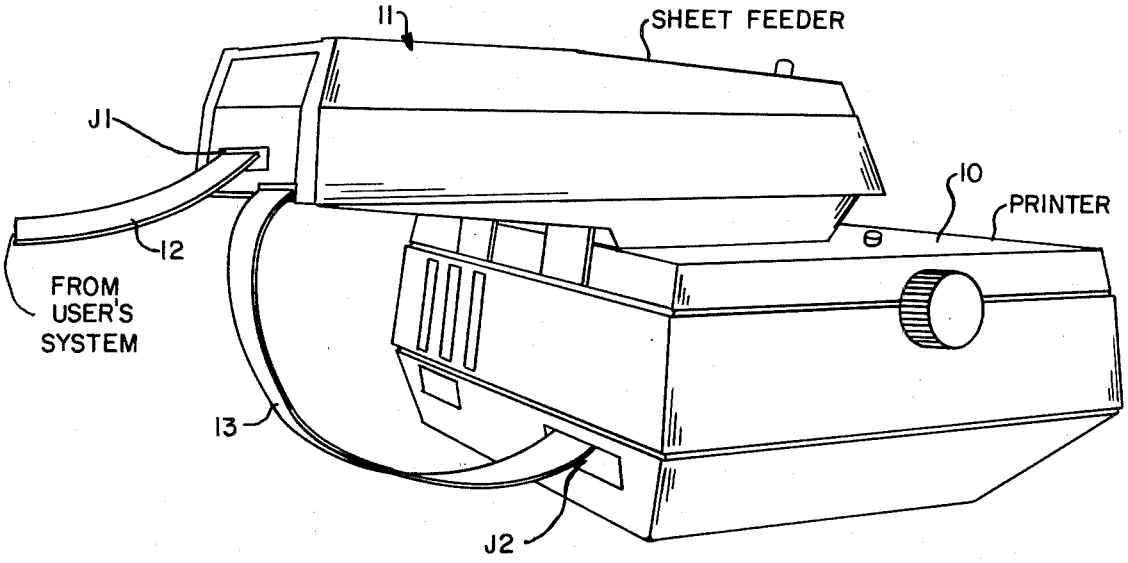
FIG. 1 is a perspective view of a printer and sheet feeder embodying the present invention.

Referring now to FIG. 1, there is illustrated a daisywheel type impact character printer 10 with a sheet feeder 11 physically mounted on it. Printer 10 may be one of several commercial types available, for example, on an OEM basis from Qume Corporation or from the Diablo Division of the Xerox Corporation or a typewriter or broadly any printer with a platen. In addition, the printer 10 may include a keyboard for use as a memory type office typewriter. Such printers include a connector J2 or input port having, for example, 50 pins to which a data cable from the user or customer would normally be connected. In general, the port J2 would have sufficient pins to accept a parallel digital print code such as an ASCII print code with, for example, 14 of the pins being reserved for data. In addition, other pins include control lines such as restore, character strobe, carriage strobe, paper feed strobe, top of form strobe, ribbon lift command, printer select, input buffer ready, printer ready, and paper out. The foregoing specific set of pin assignments specifically apply to the SPRINT MICRO III printer (trademark) of Qume Corporation of the present invention but in general are applicable to many other types of character printers which are remotely controllable by coded logic signals one of which is ASCII.

In accordance with the invention when automatic sheet feed is desired the sheet feeder 11 is mounted on printer 10, the cable 12 from the user system disconnected from port J2 and the cable 13 from the sheet feeder 11 is instead connected to the port or junction J2. Then the data cable 12 that was removed from the printer 10 is connected to the junction connector J1 of sheet feeder 11.

It is apparent from the foregoing that the character printer 10 has been converted to fully automatic operation or retrofitted by simply affixing sheet feeder 11 to printer 10 and then making the simple electrical connection; and the reason for such simplicity is in the fact that the input port J2 of the printer 10 is connected exclusively to the sheet feeder 11 which then in turn is connected to cable 12 from the user's system. Moreover, sheet feeder 11 as will be discussed below provides the proper logic for operation of the newly devised automatic paper feed and character printing system.

Figure 2A:
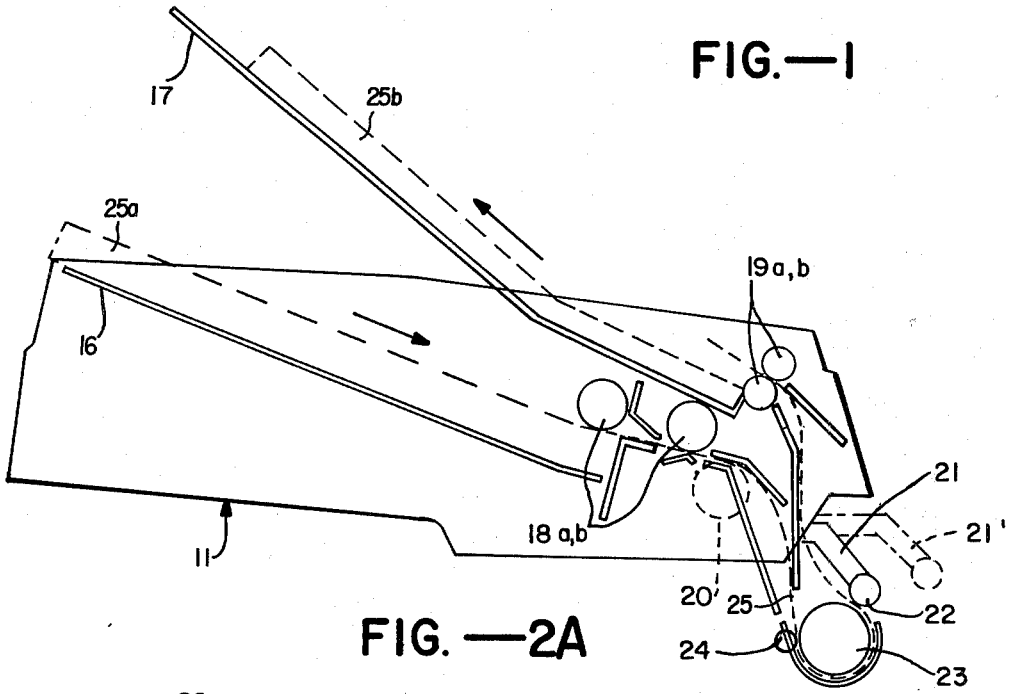
FIG. 2A is a cross-sectional view highly simplified of a portion of FIG. 1.

Sheet feeder 11 as illustrated in FIG. 2A is actually a feeder/stacker which stores, for example, letterheads to be printed upon, feeds these into the printer 10 and then provides for ejection of the sheets and stacking and storage. Specifically as illustrated in FIG. 2 sheet feeder 11 includes an input paper tray 16 holding a supply of paper sheets 25*a* an output paper tray 17 for receiving ejected paper sheets 25*b* and associated input and output rollers 18*a, b* and 19*a, b* which facilitate movement of the paper sheet 25 between the input and output trays 16,17. As thus far defined, such sheet feeder 11 is disclosed in U.S. Pat. No. 4,113,244 for an "Apparatus For Automatically Feeding Individual Sheets From A Stack Through an Office Machine," granted Sept. 12, 1978. Such a sheet feeder when used for other purposes has been sold by the Multimatics Corporation at least in Europe.

This feeder 11 has been modified by the assignee of the present invention for specific use with a character printer 10. Such modification includes the provision of a movable arm 21 which is connected to the paper bail 22 of the printer 10 which normally rests against the platen 23. As will be described below arm 21 is movable to the position 21' to open the paper bail 22 to allow paper 25 to be inserted around the platen 23 and through the gap between the open paper bail 22 and the platen 23. The feeder unit 11 produced by the Multimatics Corporation includes, of course, a motor (not shown) to drive the associated rollers 18*a,b* and 19*a,b* and also a cadence wheel 51 (FIG. 8) which includes a frictional wheel 20 (in dashed outline, but see FIG. 3B) disposed against the paper 25 as it travels out of the input tray 16 to determine when the paper 25 reaches the platen 23 and pressure roller 24. The purpose of the friction wheel 20 at least in the Multimatics unit was to stop the paper when it moved into contact with the printer's platen and pressure roller.

Figure 2B:
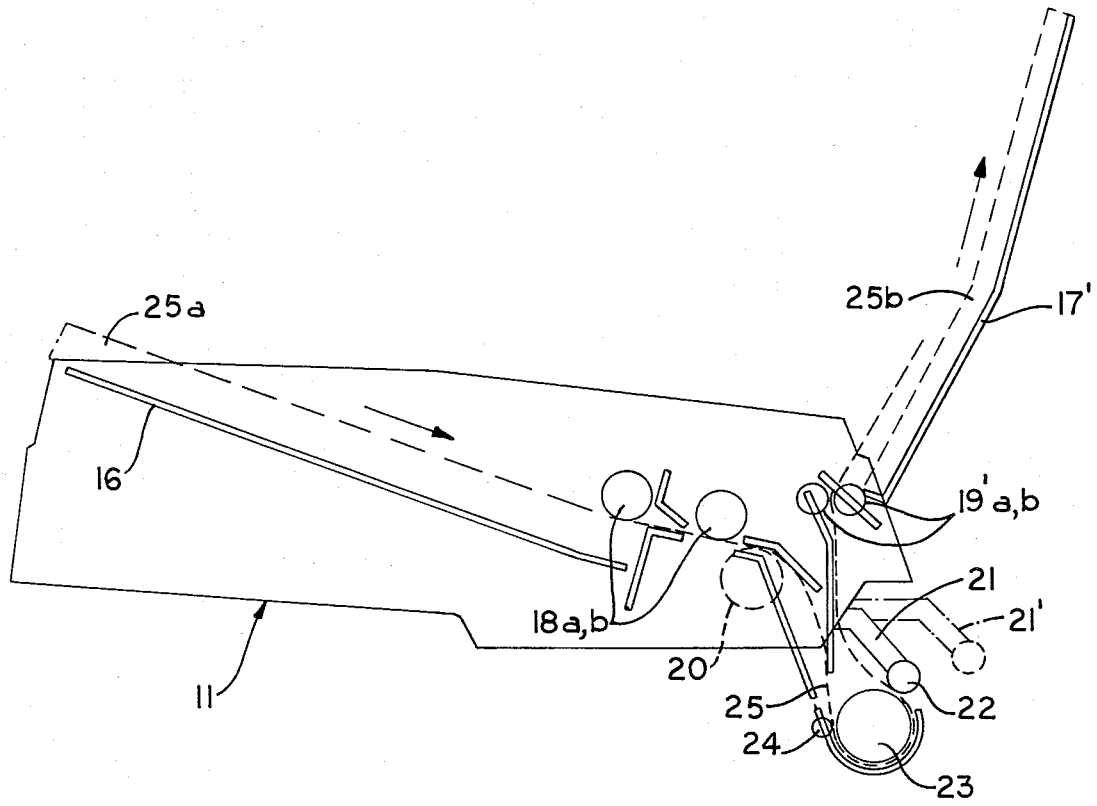
FIG. 2B shows the same cross-section as FIG. 2A, but with the receiving tray in a different position.

If it is desired to stack the ejected paper 25*b* on a first in first out basis (FIFO) receiving tray 17' and rollers 19'*a,b* can be positioned as shown in FIG. 2B so that the printed side of the paper 25*b* is stacked face down.

The present invention fully controls the printer 10 during the sheet feeding operation such that the entire process is transparent to the user's system. To initially summarize the operation of the present invention as controlled by the control logic contained in the sheet feeder 11 (or alternatively in the printer 10 or a third convenient proximate location or unit) the system works as follows:

1. Upon receipt of a command the sheet feeder 11 disables system inputs and informs the system that the feeder/printer is not ready.
2. The sheet feeder 11 signals the printer 10 to rotate its platen 23 to eject the previously printed sheet up and out of the printer 10.
3. The sheet 25 is guided and stacked in the output tray 17 forming stack 25*b*.
4. Under the control of the sheet feeder 11, a single sheet 25 of paper 25 is moved into contact with the printer's platen 23 and pressure roller 24 from supply stack 25*a*.
5. By actuation of the arm 21, the paper bail 22 is moved out of the way.
6. The sheet feeder 11 signals the printer 10 to rotate the platen 23 and moved the paper 25 around to a proper starting point or first printing row. The number of increments for such motion is stored in digital logic in the sheet feeder 11.
7. The sheet feeder 11 closes the paper bail 22 allowing it to hold down the paper 25.
8. The sheet feeder 11 clears all of its logic and normal printing is given over to the customer's typical ASCII input on its cable 12.

In general, all of the printer interface lines except "top of form strobe" and "paper out" pass through the sheet feeder 11. Thus, when the sheet feeder 11 is not operating, it can be considered in the "idle" mode.

Figure 3A:
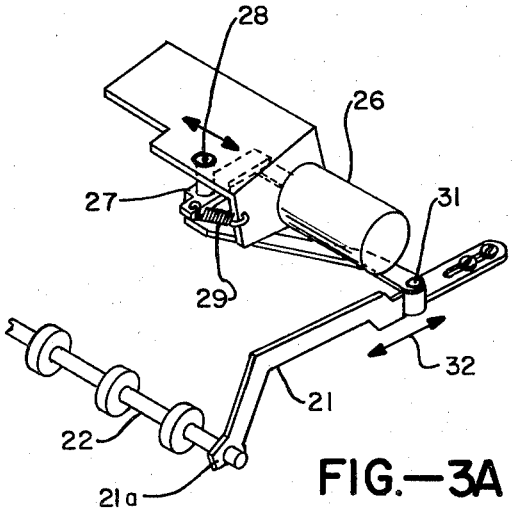
FIG. 3A is an enlarged perspective view of a portion of FIG. 2A showing the operation of the paper bail.
Figure 3B:
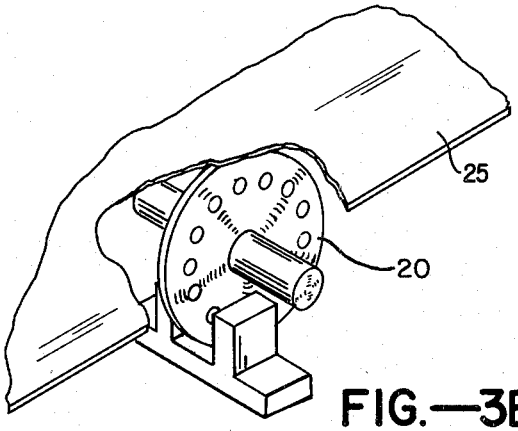
FIG. 3B is a enlarged perspective view of another portion of FIG. 2A showing a cadence wheel.

FIG. 3A illustrates the operation of the arm 21 which moves bail 22 to an open position when necessary. The arm 21 is actuated by a solenoid 26 driven by the control logic of the sheet feeder 11 and is also mounted physically on the sheet feeder 11 itself. A pivot arm 27 is pivoted on an axis 28 and biased in a counter clockwise direction by a spring 29 connected to the pivot arm 27. Arm 21 is connected to the pivot arm 27 at point 31. Arm 21 is suitably mounted so that it can slide or move in the direction indicated by the arrow 32. Actuation of solenoid 26 causes it to pull in and thus rotate pivot arm 27 in a clockwise direction to move the arm 21 in the direction shown by arrows 32. Arm 21 includes the open end 21*a* which is easily placed on bail 22 when the sheet feeder unit 11 is placed on top of the printer 10.

Figure 4:
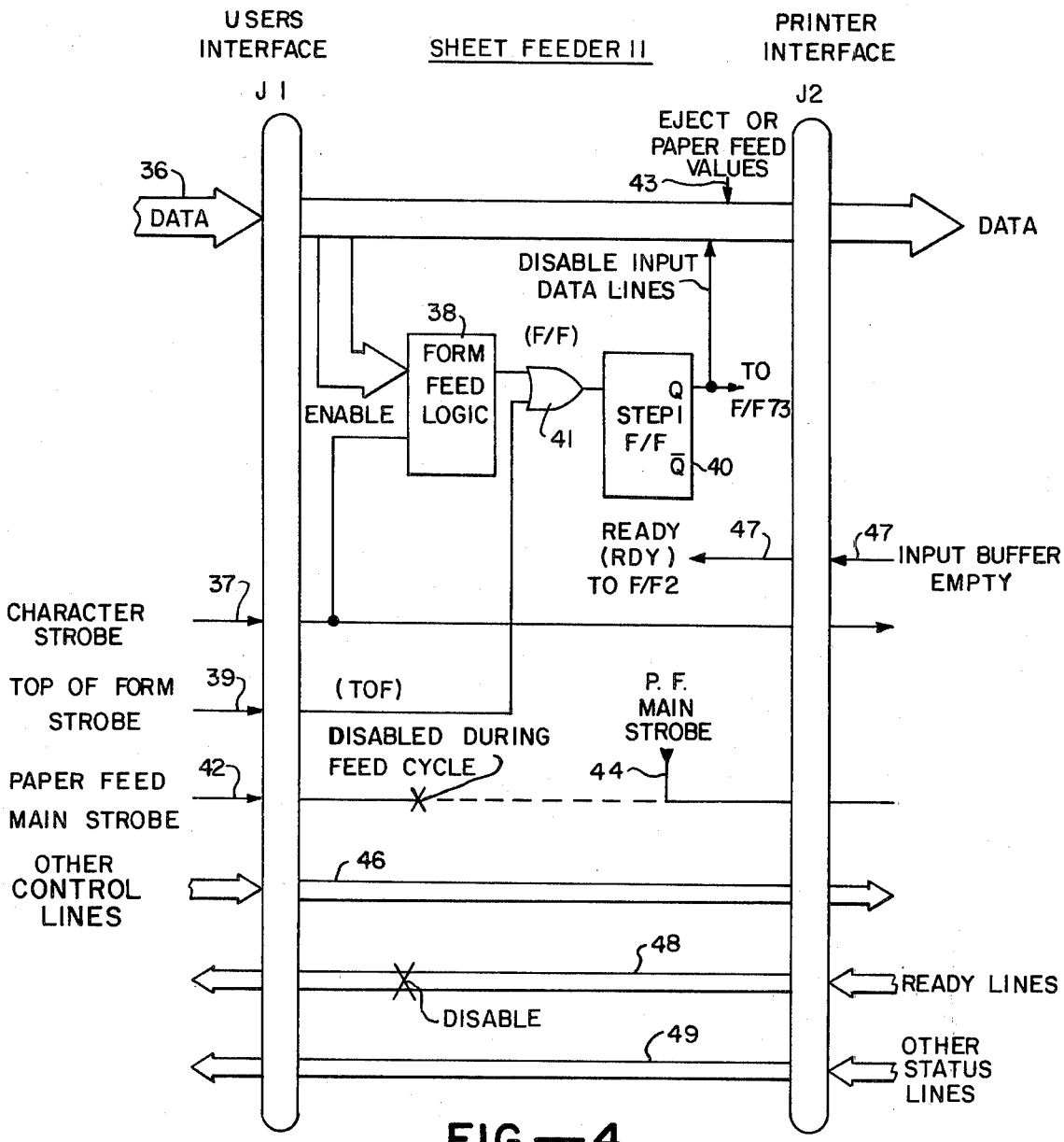
FIG. 4 is a diagrammatic view illustrating the electrical interconnections of the units of FIG. 1.

FIG. 4 illustrates the function of the sheet feeder 11 in interconnecting the user's interface at junction J1 to the printer 10 at junction J2. The data line 36 from the user's logic, which carries on it the various ASCII character, carriage, and paperfeed codes, extends through to the printer 10 and is controlled and disabled during the sheet feeding cycle. The character strobe line 37 is fed through to the printer 10 but is utilized to enable a form feed logic unit 38 to sense the ASCII form feed command or some other preset code which might occur on the user's input data lines 36.

The sheet feeder 11 leaves its idle mode and becomes active when either an ASCII form feed (FF) code is detected on the data lines 36 along with a character strobe on line 37 or if a top of form (TOF) command is detected on line 39. This is provided by the OR gate 41 which ORs the FF with TOF. The output of OR gate 41 actutes a step 1 flip-flop 40 which at its Q output provides for disabling the data lines 36 so that no interference is produced at the user's input during the active sheet feed cycle. A third activation technique is merely to have a manual feed button which is typically included in the control panel of the form feeder 11, but are not shown for simplicity.

Yet another input control line 42, which is designated "paper feed main strobe" (that is, controls the rotation of the platen 23 to feed the paper 25), is disabled during the sheet feed active cycle. This is because internal paper feed main strobe commands are generated in the automated printing system's internal logic (not shown) to both eject the existing paper 25 from the printer 10 into stack 25*b* and to provide for the insertion from stack 25*a* and movement of the new sheet 25 to the top of the first printing row. The proper paper feed value for these two functions are connected to the data lines 36 as indicated at line 43. The paper feed main strobe line which strobes the data value to the printer 10 is indicated at numeral 44.

The remaining control lines 46, which are unaffected by the sheet feeder 11, and pass through to the printer 10 include ribbon commands. Ready lines 48 from the printer 10 typically show the printer's input buffer (not shown) is empty or some other ready indication. They are disabled during the active cycle of the sheet feeder 11. Other status lines 49 include ribbon out and cover interlock. Lastly, the control indication from the printer 10 itself on a line 47 "input buffer empty" or other suitable indication indicates the printer 10 has finished printing one page or sheet 25 and is now ready (RDY) to accept another sheet 25 from stack 25*a*. This indication is used in the sheet feeder 11 logic system.

Figure 5A:
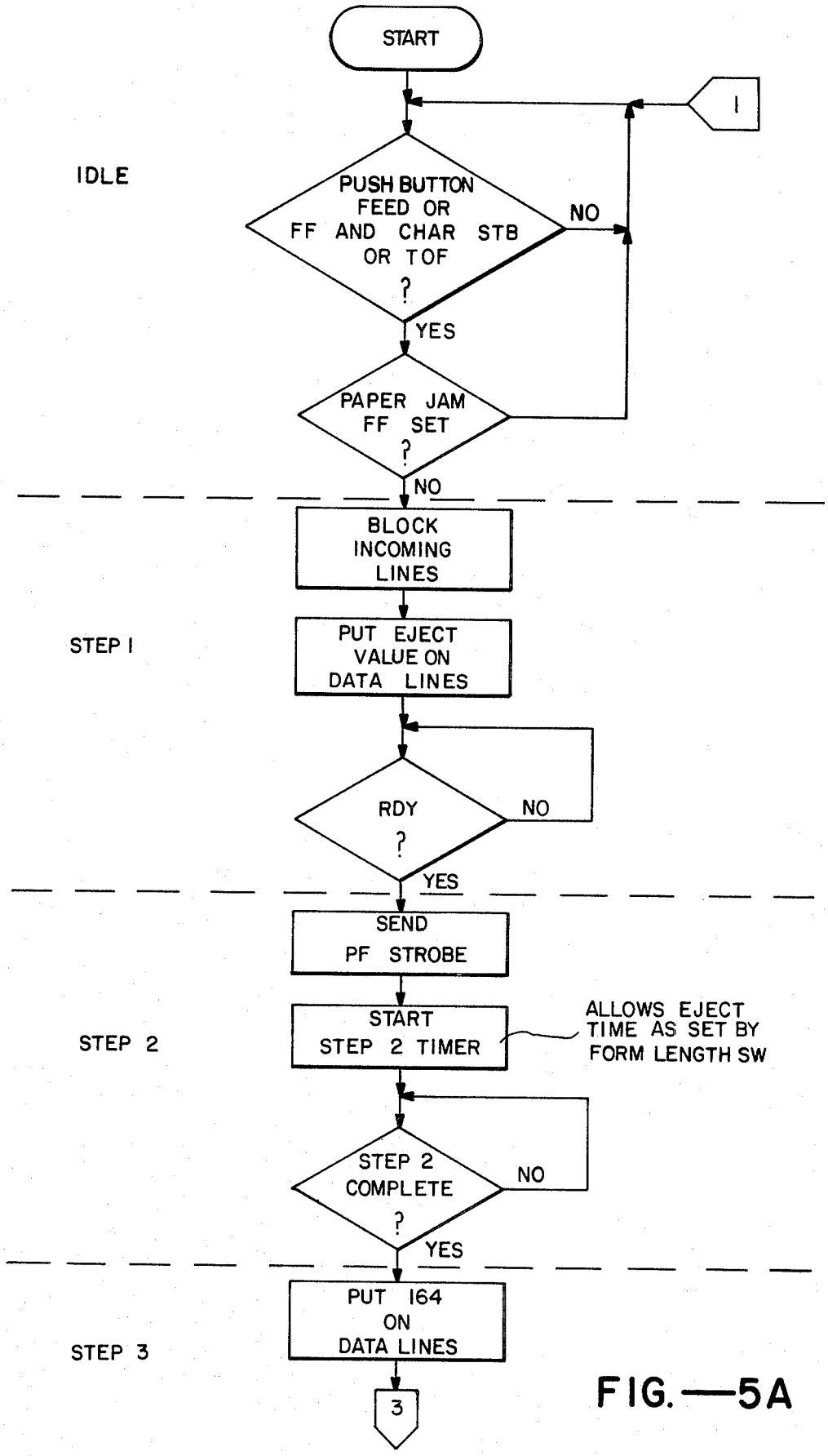
FIGS. 5A and 5B are flow charts illustrating the operation of the present invention.
Figure 5B:
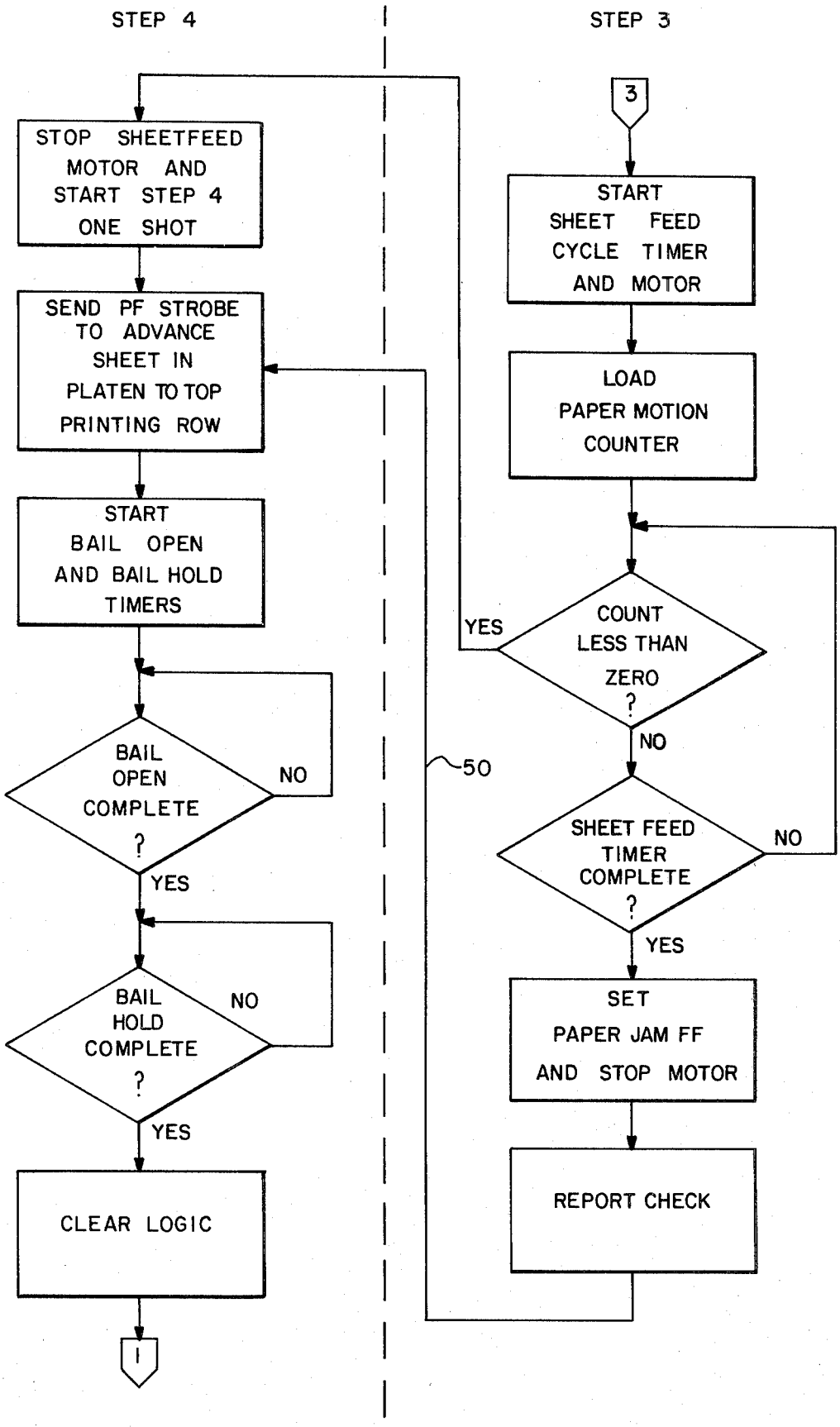

Such logic is easily understood by reference to the flow charts of FIGS. 5A and 5B. Referring now to the flow chart of FIG. 5A, the idle state is first indicated. The active sheet feed cycle will not be started unless there is a combination of an ASCII form feed (FF) data signal in combination with a character strobe or a top of form (TOF) control indication. In addition, a manual switch (feed pushbutton), of course, can be used. Next, there is a check as to whether a paper jam flip-flop 64 (FIG. 7) has been set. Flip-flop 64 will be discussed with the block diagram of FIG. 7. Assuming both of the idle conditions are satisfied, the active phase is entered designated step 1. Here the incoming data lines 36 as illustrated in FIG. 4 are blocked and an eject value as shown by the line 43 is placed on the data lines 36.

A ready (RDY) indication on line 47 then allows the sheet feeder 11 to proceed to step 2. Here a paper feed (PF) strobe on the line 44 of FIG. 4, for example, utilizes the eject value (in proportion to 11 inch or 14 inch paper) to actuate the paper feed stepping motor of the printer 10. A step 2 timer 76 (FIG. 7) is started which allows sufficient eject time for the specific form length. The sheet feeder 11 is then in its step 3. A value of 164 is placed on the data lines 36 as indicated at 43 (FIG. 4) to provide a paper feed value which will be used later in step 4 to advance the new sheet 25 to the top printing row. Continuing on with step 3, in the next block the sheet feed motor is started to begin to feed A sheet from stack 25*a* on input tray 16 into contact with the platen 23 and its pressure roller 24. An associated cycle timer 81 (FIG. 7) also starts timing to give the sheet feeder 11 a predetermined limited time of, for example, nine seconds in which to feed the paper 25 to the platen 23. Such feeding is monitored by a paper motion counter 52 (see FIG. 8) which is initially loaded with a number of counts, for example, 45. Such counts are produced by the friction wheel 20 of the sheet feed mechanism shown in FIG. 3B. As long as the count is greater than 0, the sheet feed cycle timer 81 is in control and if the timer period of for example nine seconds ends before the count is less than 0, a paper jam flip-flop is set and the sheet feed motor stops. The "report check" block sets an error light (not shown) on the mechanism and sends a check status to the system. As illustrated by line 50 in FIG. 5B, the sheet feeder 11 will still complete step 4 prior to returning to the idle state in order to eject any paper 25 in the printer 10.

However, if the sheet feed to the platen 23 is successful, then the "count less 0" provides the Yes which moves the sheet feed into its final step 4. At this point in time the sheet feed motor is, of course, stopped. In step 4 a one shot 79 (FIG. 7) is activated which provides a paper feed strobe to cause the 164 value already on the data lines 36 to rotate the platen 23 and advance the sheet 25 to the top printing row. At the same time, the arm 21 of the sheet feeder 11 moves the bail 22 open and it is held open a sufficient time as indicated by the blocks "bail open complete?" and "bail hold complete?" to allow the pper 25 to advance to the top printing row. At this point, all logic is cleared, the sheet feeder 11 returns to its idle cycle and allows the user's ASCII input commands to now control the printer 10.

If it is desired to print on the top one inch, for example, of a sheet of paper 25, step 4 can be modified to hold the bail 22 open to allow this printing. Then a separate ASCII code can be decoded to close the bail 22.

Figure 8:
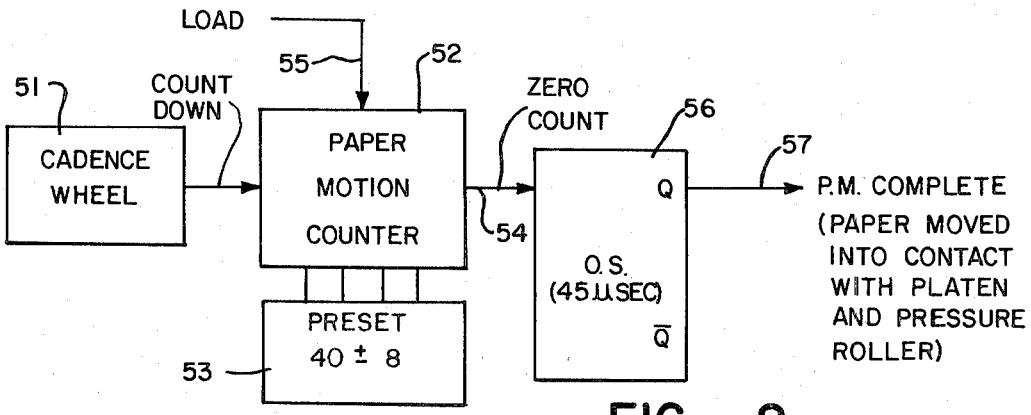
FIGS. 7 and 8 are logic block diagrams embodying the present invention.
Figure 6:
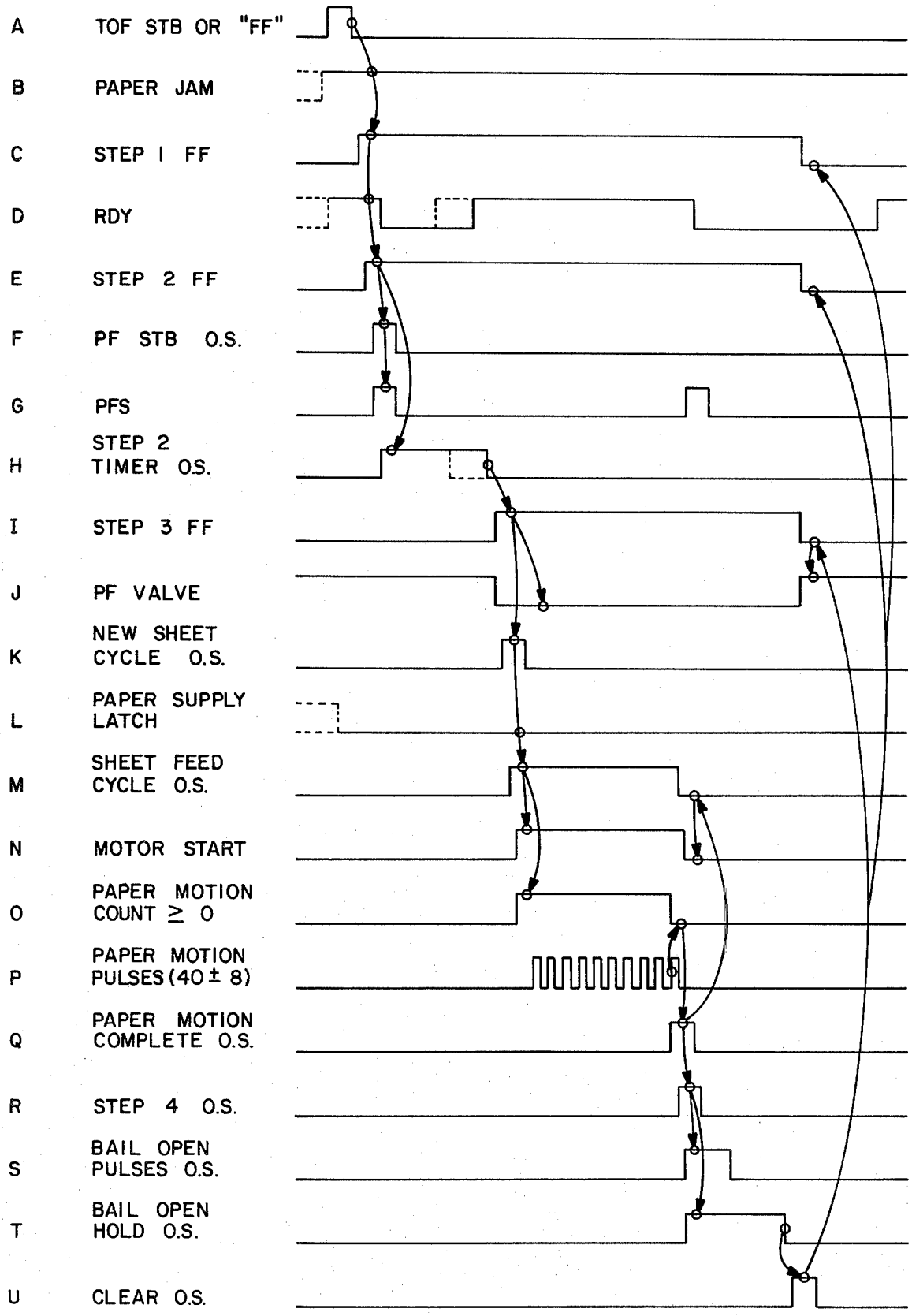
FIGS. 6 is a timing diagram showing the operation of the present invention.
Figure 7:
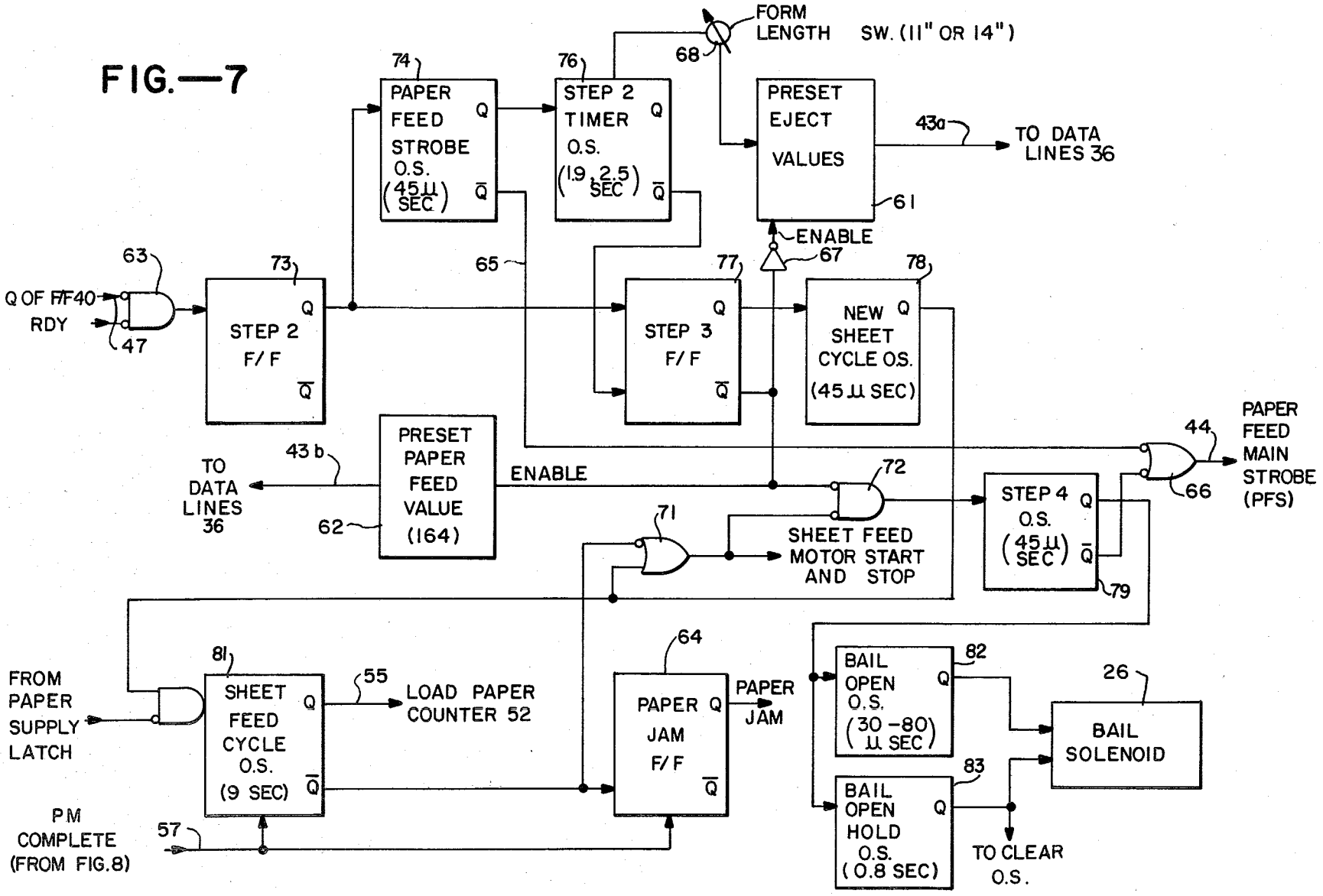

The logic block diagrams of FIGS. 7 and 8 taken in conjunction with the timing diagrams of FIG. 6, reference letters A through U specifically illustrate the flow chart of FIGS. 5A and 5B. The arrows in FIG. 6 indicate the sequence of steps. These will be followed in conjunction with the schematic logic block diagram of FIGS. 7 and 8. All of these logic units are included in the sheet feeder 11 along with those blocks indicated in FIG. 4.

The sheet feeder friction wheel 20 (see FIGS. 2 and 3B) is illustrated in FIG. 8 as block 51. This, of course, senses the paper 25 moving out of the sheet feeder 11 into contact with the platen 23 and pressure roller 24. A paper motion counter 52 stores a preset count of, for example, 45 as indicated by the block 53 and is loaded by load line 55 at the proper time in the active cycle in the sheet feeder 11. Counter 52 decrements as cadence wheel 51 turns and eventually produces a 0 count on line 54 (see the count less than 0 block, step 3, FIG. 5B). This sets a paper motion complete one shot unit 56 which on its Q output line 57 produces the PM complete signal which is actually the Yes signal of the "count less than the zero?" block in FIG. 5B. In any case, the paper 25 is moved into contact with the platen 23 and pressure roller 24.

Referring to FIG. 7, the paper feed main strobe (PFS) line 44 (also shown in FIG. 4) is indicated along with the bail solenoid 26. The paper motion complete line 57 of FIG. 8 enters at the bottom of FIG. 7. The eject or paper feed value on line 43 to the data lines 36 as shown in FIG. 4 is illustrated as two lines 43*a* and 43*b*; line 43*a* delivers the preset eject value in unit 61 to the data lines 36 and line 43*b* delivers the preset paperfeed value of unit 62 to the data lines 36. In practice units 61 and 62 consist of common logic. Finally, referring to the AND gate 63 in the upper left hand portion of the drawing, this shows the circuit architecture of the transition from the idle state to the active feed cycle 1 where the step two flip-flop 73 is activated in response to a true output at the Q output of flip-flop 40 of FIG. 4 along with the RDY input on line 47 is activated. Referring to the timing diagram of FIG. 6, the top of form strobe or form feed pulse (reference letter A), in the absence of a paper (reference letter B) jam as indicated by paper jam flip-flop 64, allows, as shown at reference letter C the step 1 flip-flop 40 to be set. Assuming, as illustrated at reference letter D, that RDY is true, the step 2 flip-flop 73 is activated (reference letter E) which in turn actuates the paper feed strobe one shot 74 (reference letter F). The time of each one shot pulse is given in parenthesis in FIG. 7; in this case 45 microseconds for one shot 74. The Q output of the paper feed strobe one shot 74, line 65, is in essence an eject command on paper feed main strobe line 44 via the associated OR gate 66 (see FIG. 7). Already on the data line 36, by means of line 43*a*, is the eject value which was present at the initiation of the active sheet feed cycle since in step 3 the $\overline{Q}$ output of the step 3 flip-flop 77 (see FIG. 6 reference letter I) was low at the time and this was inverted at inverter 67 to enable the eject value in unit 61 (see FIG. 7). The output of step 2 timer one shot 76 (FIG. 6 reference letter H) is also actuated by the paper feed strobe one shot 74 and has its time of specifically 1.9 or 2.5 seconds adjusted by the form length switch 68 which is contained on a control panel of sheet feeder 11. The $\overline{Q}$ output of the step 2 timer 76 (see step 2 of FIG. 5A) allows sufficient time for the old sheet 25 in the printer 10 to be ejected and then sets the step 3 flip-flop 77. This in turn activates the new sheet cycle one-shot 78 meaning that a new sheet 25 is to be fed from the sheet feeder 11 into contact with the platen 23 and pressure roller 24 of the printer 10. Reference letter J of FIG. 6 indicates that at this time the paper feed (PF) value, see block 62, is enabled on the data lines 36 via line 43*b* and the eject value on line 43*a* is removed. Reference letter K of FIG. 6 shows the new sheet cycle one shot 78 being set which in turn, assuming the paper supply latch (not shown) is true, sets the sheet feed cycle one shot 81 (see reference letter M). This is the sheet feed cycle timer illustrated in step 3 of FIG. 5B which assures that no jams occur while the sheet feed motor is feeding the new sheet 25 to the platen 23 and pressure roller 24. Activation of the sheet feed cycle one shot 81 causes its Q output on line 55 to load the paper counter 52 (FIG. 8) and on its $\overline{Q}$ output, illustrated at reference letter N, to start the sheet feed motor via the OR gate 71. Reference letter P illustrates the counting by the cadence wheel 51 (FIG. 8) of the paper motion and when the paper motion is complete as indicated on the line 57 (reference letter Q), the associated sheet feed cycle one shot 81 and the paper jam flip-flop 64 are reset. The motor is also stopped via OR gate 71.

As illustrated at reference letter R of FIG. 6 and FIG. 7 the step four flip-flop 79 is set according to the output of the AND gate 72. The flip-flop 79, by means of its Q output line, activates both the bail open one shot 82 and the bail open hold one shot 83. See reference letters S and T of the timing diagram, FIG. 6. These one shots 82,83 in turn actuate the bail solenoid 26. In addition the $\overline{Q}$ output of the step 4 one shot 79 by means of OR gate 66 provides another paper feed main strobe on line 44 (see reference letter F) from the preset paper feed value in block unit 62 to move the paper 25 to the first printing position or row. A bail open hold time of 0.8 seconds provides sufficient time for this to happen and thereafter the clear one shot (not shown, but see reference letter U of FIG. 6) is activated from the Q output to provide the various resetting indicated in FIG. 6.

Very briefly, the purpose of the bail open one shot 82 in combination with the bail open hold one shot 83 is to provide an additional voltage to the bail solenoid 26 (FIG. 3A) to overcome its opening resistance. The foregoing completes the operation of the system. Minor control features such as a lack of paper 25*a* in the supply tray 16, etc. have been eliminated for the sake of simplicity.

Thus, an automatic method and apparatus for the entire sheet feed cycle is transparent to the user. Although such control has been illustrated in conjunction with the sheet feeder, it could reside in the printer or a third unit.

What is claimed is:

1. A method for automatically feeding a printer with cut sheets of material to be printed upon, said printer having a platen rotatable by paper feed control signals and a port with standard digital type data and control lines, said method comprising the following steps: providing a sheet feeder, holding cut sheets of material on said printer; connecting said port of said printer to said sheet feeder; connecting external data and control lines to said sheet feeder; and controlling by use of digital logic within said sheet feeder at least the paper feed of said printer to accept a sheet from said sheet feeder.

2. A method as in claim 1 wherein said port of said printer is connected exclusively to said sheet feeder.

3. A method as in claim 1 wherein said printer has a bail and including the step of opening said bail by use of moving means included in said sheet feeder.

4. An automatic printing system using a stack of cut sheets comprising:

printer means including a platen rotatable by paper feed control signals, a bail and a port with standard digital type data and control lines for printing on a sheet;

a sheet feeder for storing said stack of cut sheets and mounted in proximity to said printer means and control logic means in proximity to said printer means and said sheet feeder responsive and connected to said standard digital type data and control lines to cause said sheet feeder to move a cut sheet from said stack to said platen and to activate said platen of said printer means to accept a sheet from said sheet feeder, said sheet feeder including arm means extending from said sheet feeder to said bail for moving said bail away from said platen, said logic means causing said bail to be moved away from said platen to enable said sheet to be moved between said bail and platen.

* * * * *